US006513448B2

(12) United States Patent
Kobayashi

(10) Patent No.: US 6,513,448 B2
(45) Date of Patent: Feb. 4, 2003

(54) SEWING MACHINE HAVING BALANCE

(75) Inventor: Hajime Kobayashi, Moriguchi (JP)

(73) Assignee: Jaguar International Corporation, Moriguchi (JP)

( * ) Notice: Subject to any disclaimer, the term of this patent is extended or adjusted under 35 U.S.C. 154(b) by 0 days.

(21) Appl. No.: 09/988,192

(22) Filed: Nov. 19, 2001

(65) Prior Publication Data

US 2002/0178982 A1 Dec. 5, 2002

(30) Foreign Application Priority Data

May 31, 2001 (JP) ..... 2001-163699

(51) Int. Cl.[7] ..... D05B 69/24
(52) U.S. Cl. ..... 112/275; 112/241; 112/278
(58) Field of Search ..... 112/275, 278, 112/273, 241, 57, 96

(56) References Cited

U.S. PATENT DOCUMENTS 4,817,545 A * 4/1989 Mikuni et al. ..... 112/241
5,383,417 A * 1/1995 Norrid ..... 112/278

* cited by examiner

*Primary Examiner*—Peter Nerbun
(74) *Attorney, Agent, or Firm*—Armstrong, Westerman & Hattori, LLP

(57) ABSTRACT

A sewing machine capable of preventing formation of no first stitch (skipping stitch), which is readily caused immediately after the sewing machine starts to operate, is obtained. This sewing machine comprises a first detector detecting that a thread engaging part of a balance is located in the vicinity of a forward movement starting point leftward beyond a thread receiving opening of a thread guide plate and an indicator operating on the basis of a detection signal received from the first detector. Thus, the operator can recognize that the thread engaging part of the balance is located in the vicinity of the forward movement starting point leftward beyond the thread receiving opening of the thread guide plate through the indicator. When the operator moves the balance to a position for turning on the indicator, guides a needle thread and thereafter operates the sewing machine, therefore, the thread engaging part of the balance reliably captures and pulls the needle thread also immediately after the sewing machine starts to operate. Consequently, formation of no first stitch (skipping stitch), which is readily caused immediately after the sewing machine starts to operate, is prevented.

10 Claims, 3 Drawing Sheets

SEWING MACHINE HAVING BALANCE

BACKGROUND OF THE INVENTION

1. Field of the Invention

The present invention relates to a sewing machine, and more particularly, it relates to a sewing machine having a balance.

2. Description of the Prior Art

A sewing machine having a balance is known in general. This balance has a thread engaging part. The balance is so structured that the thread engaging part captures and pulls a needle thread when forwardly moving from left to right. In this case, the thread engaging part of the balance engages with the needle thread passing through thread receiving openings of a pair of thread guide plates for pulling the same.

When a sewing machine operating switch of the conventional sewing machine having the aforementioned structure is moved to OFF for stopping the sewing machine, however, a motor is generally stopped when a needle is located on a top dead center. When the needle is located on the top dead center, the thread engaging part of the balance is generally located on an intermediate position of the passage for the forward movement beyond the thread guide plates. In other words, the motor is generally stopped regardless of the position of the thread engaging part of the balance.

Therefore, when the sewing machine operating switch is moved to ON after the needle thread is exchanged, for example, the sewing machine starts the first operating cycle without capturing and pulling the needle thread by the thread engaging part of the balance. Thus, the needle thread has no prescribed slack in the first operating cycle of the sewing machine and hence a slack portion formed on a lower portion of cloth for engaging with the forward end of a shuttle body disappears following an operation of a thread take-up spring pulling up the needle thread when the needle passes through the cloth. This may disadvantageously result in formation of no first stitch (the so-called skipping stitch).

When the sewing machine operating switch is moved to ON without exchanging the needle thread, the needle thread may be in a state disengaging from the thread engaging part of the balance due to slacking during the unused state of the sewing machine. In this case, inconvenience similar to the above takes place to disadvantageously result in the so-called skipping stitch.

SUMMARY OF THE INVENTION

An object of the present invention is to provide a sewing machine capable of preventing formation of no first stitch (the so-called skipping stitch), which is readily caused immediately after the sewing machine starts to operate.

Another object of the present invention is to automatically move a balance in the aforementioned sewing machine.

A sewing machine according to an aspect of the present invention comprises a thread guide plate having a thread receiving opening, a balance having a thread engaging part and reciprocating through the thread guide plate so that the thread engaging part captures and pulls a needle thread when forwardly moving from left to right, a first detector detecting that the thread engaging part of the balance is located in the vicinity of a forward movement starting point leftward beyond the thread receiving opening of the thread guide plate and an indicator operating on the basis of a detection signal received from the first detector.

The sewing machine according to this aspect is provided with the first detector detecting that the thread engaging part of the balance is located in the vicinity of the forward movement starting point leftward beyond the thread receiving opening of the thread guide plate and the indicator operating on the basis of the detection signal received from the first detector as described above, whereby the operator can recognize that the thread engaging part of the balance is located in the vicinity of the forward movement starting point leftward beyond the thread receiving opening of the thread guide plate through the indicator. When the operator moves the balance to a position for turning on the indicator, guides the needle thread and thereafter operates the sewing machine, therefore, the thread engaging part of the balance can reliably capture and pull the needle thread also immediately after the sewing machine starts to operate. Consequently, formation of no first stitch (skipping stitch), which is readily caused immediately after the sewing machine starts to operate, can be prevented.

The sewing machine according to the aforementioned aspect preferably further comprises an upper shaft so rotating that the balance reciprocates in association with rotation thereof, a motor driving the upper shaft and a thread guide mode switch driving the motor. According to this structure, the balance can be automatically moved with the thread guide mode switch, whereby operability in thread guiding can be improved. In this case, the motor is preferably stopped on the basis of the detection signal from the first detector after the thread guide mode switch is moved to ON. According to this structure, the thread engaging part of the balance can be automatically moved to the position in the vicinity of the forward movement starting point leftward beyond the thread receiving opening of the thread guide plate.

In the structure of the sewing machine comprising the upper shaft, the first detector preferably includes a first detected element provided on the upper shaft and a first photoelectric switch detecting the first detected element. In this case, the first photoelectric switch of the first detector preferably detects the first detected element when the thread engaging part of the balance is located in the vicinity of the forward movement starting point leftward beyond the thread receiving opening of the thread guide plate. According to this structure, the first detector can readily detect that the thread engaging part of the balance is located in the vicinity of the forward movement starting point leftward beyond the thread receiving opening of the thread guide plate.

The sewing machine according to the aforementioned aspect preferably further comprises a sewing machine operating switch operating the sewing machine, and the indicator is preferably responsively inactivated when the sewing machine operating switch is moved to ON. According to this structure, the indicator can be prevented from operating during operation of the sewing machine. In this case, the motor is preferably stopped to stop a needle on a top dead center when the sewing machine operating switch is moved to OFF.

The sewing machine according to the aforementioned aspect preferably further comprises a sewing machine operating switch operating the sewing machine, the indicator preferably includes an LED, and the LED is preferably turned on when receiving the detection signal from the first detector while the motor is stopped and turned off when the sewing machine operating switch is moved to ON. According to this structure, the operator can readily recognize that the thread engaging part of the balance is located in the vicinity of the forward movement starting point leftward beyond the thread receiving opening of the thread guide plate when the LED is turned on.

The sewing machine comprising the aforementioned upper shaft preferably further comprises a second detector for detecting at least the rotational position of the upper shaft, and the motor is preferably stopped on the basis of a detection signal received from the second detector. According to this structure, the motor can be readily stopped when the upper shaft reaches a prescribed rotational position, for example. Thus, the motor can be stopped on a prescribed position such as the top dead center of the needle by controlling the relation between the rotational position of the upper shaft and the position of the needle. In this case, the second detector includes a second detected element provided on the upper shaft and a second photoelectric switch detecting the second detected element. According to this structure, the rotational position of the upper shaft can be readily detected.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

Figure 1:
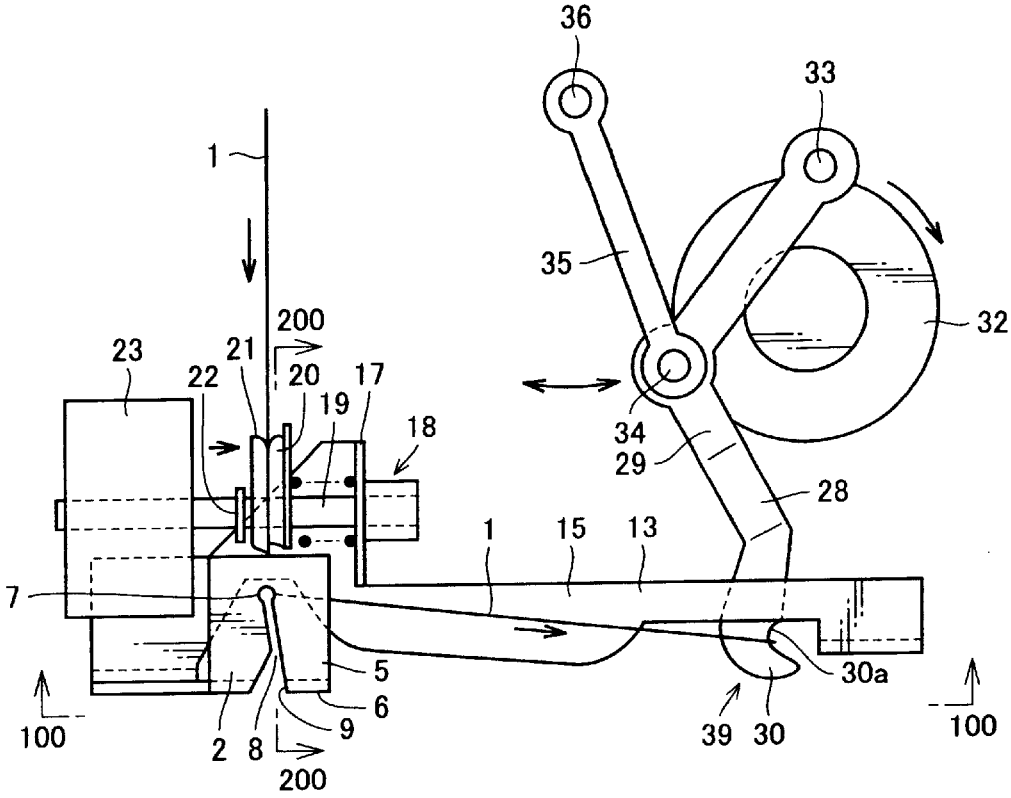
FIG. 1 is a partial plan view of a sewing machine according to an embodiment of the present invention.
Figure 2:
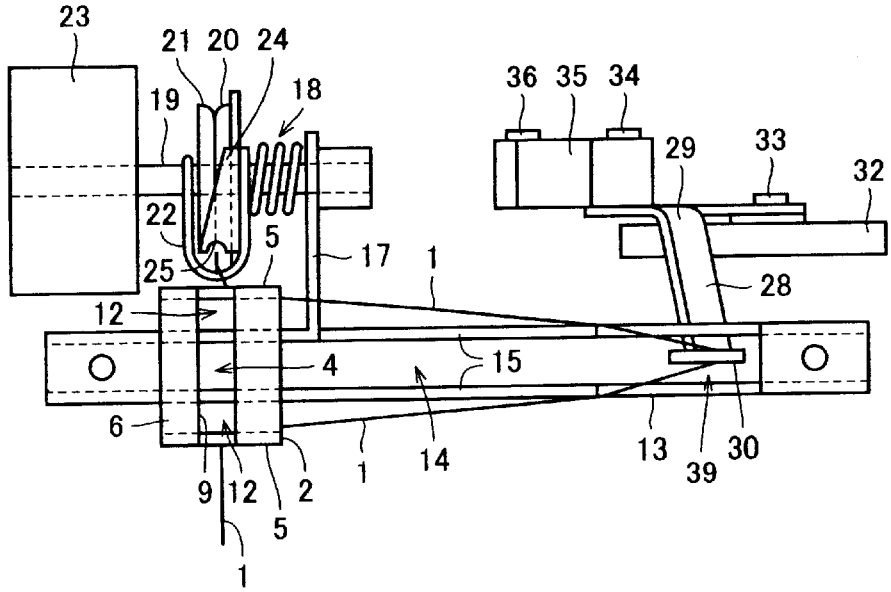
FIG. 2 is a sectional view of the sewing machine according to the embodiment taken along the line 100—100 in FIG. 1.
Figure 3:
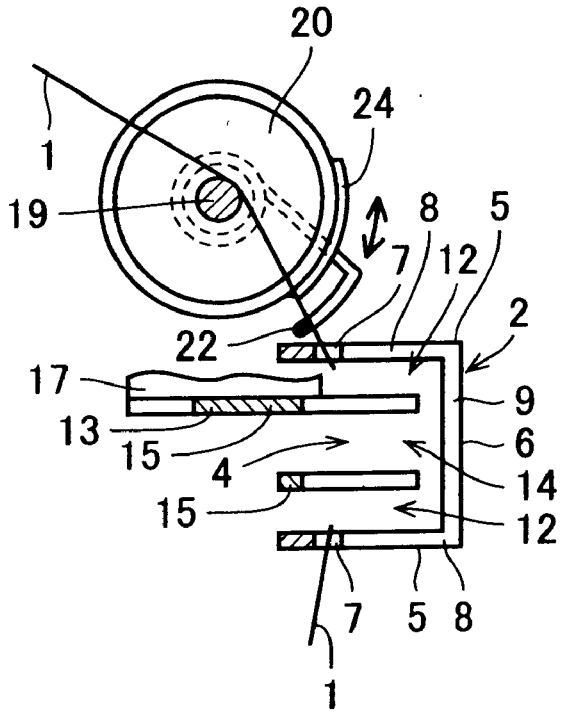
FIG. 3 is a sectional view of the sewing machine according to the embodiment taken along the line 200—200 in FIG. 1.

Referring to a plan view of FIG. 1, the lower side shows a front part of a sewing machine according to the embodiment, and the upper side shows a rear part of the sewing machine. The left side shows a left part of the sewing machine, and the right side shows a right part of the sewing machine.

In the sewing machine according to this embodiment, a needle thread receiving groove (not shown) opening frontward, upward and downward is provided on a left front portion of a sewing machine body arm (not shown). This needle thread receiving groove is formed to overlap with a virtual vertical plane horizontally dividing the sewing machine body arm including a needle (not shown). A thread guide part 2 is mounted on the sewing machine body arm (not shown) to be opposed to the needle thread receiving groove.

The thread guide part 2 includes a pair of thread guide plates 5 and a coupling plate 6. The pair of thread guide plates 5 are opposed to each other through a balance passage clearance 4 allowing passage of a thread engaging part 30 of a balance 28. The coupling plate 6 is provided on front edges of the thread guide plates 5 to couple the pair of thread guide plates 5 with each other. The pair of thread guide plates 5 are provided with thread receiving openings 7 and slits 8 for guiding a needle thread 1 into the thread receiving openings 7 respectively. The coupling plate 6 is formed with a slit 9 communicating with the slits 8.

L 10The sewing machine body arm (not shown) is provided with a balance guide body 13. The balance guide body 13 has a vertical pair of horizontal plates 15 opposed to each other through a balance passage clearance 14 allowing passage of the thread engaging part 30 of the balance 28. The horizontal plates 15 are arranged not to block the thread receiving openings 7 and the slits 8 of the thread guide plates 5. Further, the balance guide body 13 is arranged to define clearances 12 between the same and the upper and lower thread guide plates 5 respectively. A bracket 17 is provided on a left portion of the upper horizontal plate 15. A thread tension guide 18 is mounted on the bracket 17. The thread tension guide 18 includes a spindle 19, a thread holding element 20, another thread holding element 21, a thread take-up spring 22, urging means (not shown), a dial 23 and a thread guide 24. The spindle 19 is mounted on the bracket 17 to horizontally direct its shaft center. The thread holding element 20 is fixed to the spindle 19. The other thread holding element 21 is engaged with the spindle 19 to be horizontally movable but not rotatable.

The thread take-up spring 22 is mounted on the spindle 19 to be vertically swingable within a prescribed angular range. This thread take-up spring 22 swings upward in an ordinary state receiving no force. The urging means (not shown) is formed to urge the horizontally movable left thread holding element 21 toward the right thread holding element 20. This urging means (not shown) is structured not to inhibit the thread take-up spring 22 from vertical swinging. The dial 23 is provided for controlling the force of the urging means. The thread guide 24, provided on a front edge portion of the right thread holding element 20, has a thread guide groove 25 on its lower portion.

The balance 28 has the thread engaging part 30 horizontally passing through the balance passage clearance 4 defined between the thread guide plates 5. The thread engaging part 30 has an engaging edge 30*a*. An end of a body 29 of the balance 28 is mounted on a peripheral edge portion of a turntable 32 through a shaft 34. An intermediate portion of the body 29 of the balance 28 is mounted on a connecting bar 35 through a shaft 34. The other end of the connecting bar 35 is mounted on the sewing machine arm (not shown) through a shaft 36.

Figure 4:
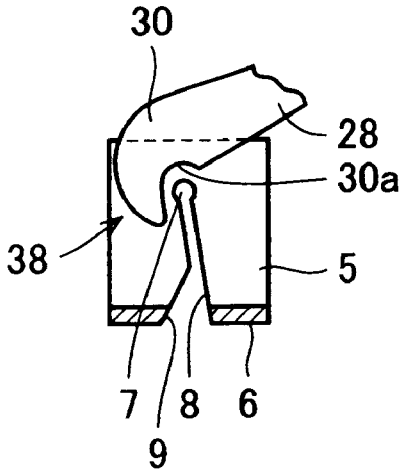
FIG. 4 is a plan view showing a thread engaging part of a balance located on a forward movement starting point in the structure of the sewing machine according to the embodiment shown in FIG. 1.

In the aforementioned structure, the thread engaging part 30 of the balance 28 moves (forward) from a forward movement starting point 38 located on the leftmost side shown in FIG. 4 to a forward movement end point 39 located on the rightmost side shown in FIG. 1. Thereafter the thread engaging part 30 moves (backward) from the forward movement end point 39 to the forward movement starting point 38. In other words, the passage from the forward movement starting point 38 to the forward movement end point 39 is for the forward movement, and the passage from the forward movement end point 39 to the forward movement starting point 38 is for the backward movement.

At the forward movement starting point 38 shown in FIG. 4, the engaging edge 30*a* of the thread engaging part 30 is located leftward beyond the thread receiving openings 7.

The positional relation between the needle (not shown) and the thread engaging part 30 is now described. When the needle is located on a top dead center, the thread engaging part 30 is located on an intermediate position of the forward movement. When the needle is located on a bottom dead center, the thread engaging part 30 is located on a position slightly closer to the forward movement starting point 38 than an intermediate position of the backward movement.

The way of extending the needle thread 1 delivered from a spool (not shown) to the needle (not shown) is now described. The needle thread 1 delivered from the spool (not shown) passes through the clearance between the thread holding elements 20 and 21 of the thread tension guide 18, the lower side of the thread guide 24, the upper side of the thread take-up spring 22 and the thread receiving openings 7 of the upper and lower thread guides 5, to reach the eye of the needle.

Figure 5:
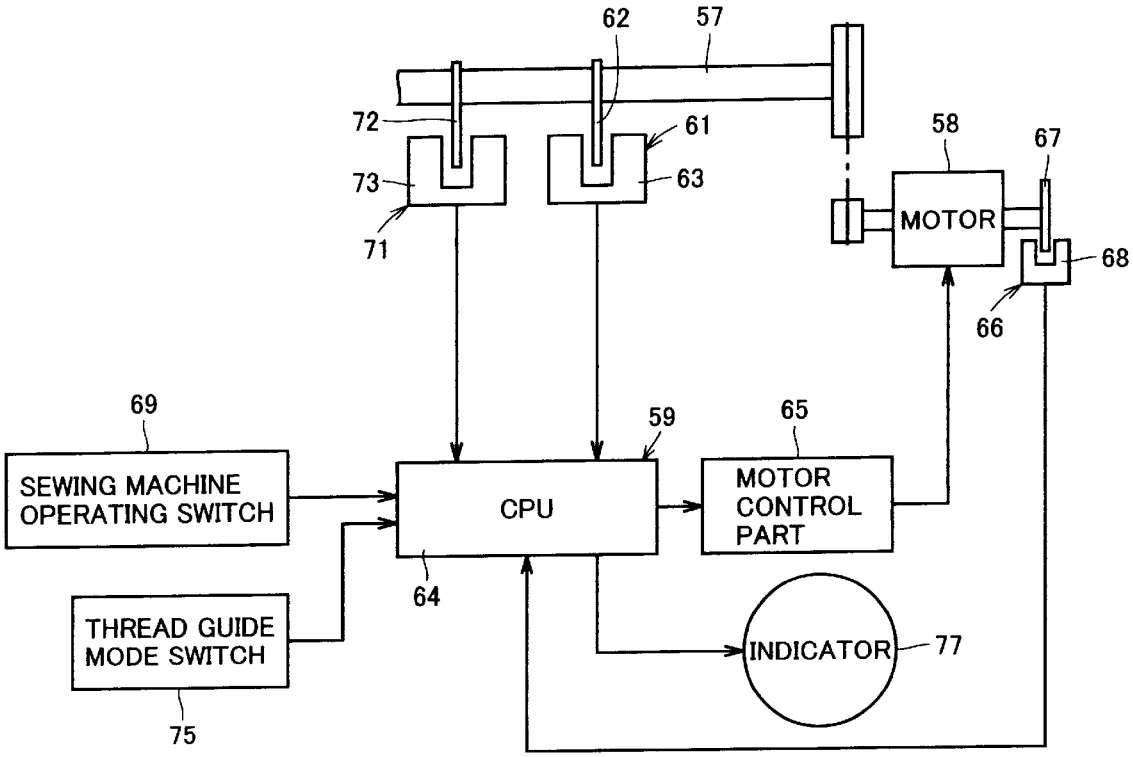
FIG. 5 is a schematic diagram for illustrating a control system for the sewing machine according to the embodiment of the present invention.

A control system for the sewing machine according to this embodiment is now described with reference to FIG. 5. According to this embodiment, a motor 58 rotates an upper shaft 57 of the sewing machine. The upper shaft 57 rotates the turntable 32 (see FIG. 1) while vertically moving the needle (not shown).

The upper shaft 57 is provided with a rotation detector 61 for detecting the number of revolutions and the rotational position of the upper shaft 57. The rotation detector 61 has a detected element 62 mounted on the upper shaft 57 and a transmission type photoelectric switch 63 detecting the detected element 62. The rotation detector 61 is an example of the "second detector" according to the present invention, and the detected element 62 is an example of the "second detected element" according to the present invention. The photoelectric switch 63 is an example of the "second photoelectric switch" according to the present invention.

The motor 58 is provided with a speed detector 66 detecting the speed of rotation of the motor 58. The speed detector 66 has a detected disc 67 and a transmission type photoelectric switch 68. The detected disc 67, mounted on the rotary shaft of the motor 58, has a plurality of detected elements on its peripheral edge portion at prescribed intervals. The photoelectric switch 68 detects the detected elements of the detected disc 67.

A computer 59 including a CPU 64 controls the motor 58. A sewing machine operating switch 69, the photoelectric switch 68 of the speed detector 66 and the photoelectric switch 63 of the rotation detector 61 are connected to the CPU 64. The sewing machine operating switch 69 is built in the sewing machine. Further, a motor control part 65 controlling an input voltage for the motor 58 is connected to the CPU 64. In addition, a thread guide mode switch 75, a transmission type photoelectric switch 73 of a detector 71 and an indicator 77 are connected to the CPU 64. The detector 71 detects that the thread engaging part 30 of the balance 28 is located in the vicinity of the forward movement starting point 38 leftward beyond the thread receiving openings 7 of the thread guide plates 5. This detector 71 has a detected element 72 mounted on the upper shaft 57 and the transmission type photoelectric switch 73 detecting the detected element 72. The detector 71 is an example of the "first detector" according to the present invention, and the detected element 72 is an example of the "first detected element" according to the present invention. The photoelectric switch 73 is an example of the "first photoelectric switch" according to the present invention. The photoelectric switch 73 is position-controlled to detect the detected element 72 when the thread engaging part 30 of the balance 28 is located in the vicinity of the forward movement starting point 38 leftward beyond the thread receiving openings 7 of the thread guide plates 5.

When the thread guide mode switch 75 is moved to ON while the sewing machine operating switch 69 is OFF, the stopped motor 58 is operated at a low speed. When the detector 71 outputs a detection signal, the motor 58 is stopped.

The indicator 77 is formed by an LED or the like. This indicator 77 is turned on only when receiving the detection signal from the detector 71 while the motor 58 is stopped. The indicator 77 is turned off when the sewing machine operating switch 69 is moved to ON.

Control operations made by the control system for the sewing machine according to this embodiment having the aforementioned structure are now described.

When the sewing machine operating switch 69 is moved to OFF, the CPU 64 receives an OFF signal therefor and transmits a deceleration signal to the motor control part 65. The motor control part 65 receiving the deceleration signal reduces the input voltage for the motor 58. Thus, the motor 58 is decelerated to enter a stoppage setup state. After the motor 58 is decelerated to a speed sufficient for stoppage, the photoelectric switch 63 of the rotation detector 61 for the upper shaft 57 is moved from OFF (for cutting off light) to ON (for passing light), so that the CPU 64 outputs a stop signal to the motor control part 65. Thus, the motor 58 is stopped. The CPU 64 detects sufficient deceleration of the speed of the motor 58 by receiving a speed signal indicating that the motor 58 reaches the speed sufficient for stoppage from the speed detector 66.

When the photoelectric switch 63 is moved from OFF to ON to stop the motor 58 as described above, the upper shaft 57 is stopped thereby stopping the turntable 32 (FIG. 1). Consequently, the needle is stopped in a state located on the top dead center. In this case, the thread engaging part 30 of the balance 28 is stopped on an intermediate position of the forward movement after passing through the thread guide plates 5.

In order to exchange the needle thread 1, for example, after the motor 58 is stopped, the needle thread 1 is first removed. Then, the thread guide mode switch 75 is moved to ON for driving the stopped motor 58 at a low speed. When the thread engaging part 30 of the balance 28 is located in the vicinity of the forward movement starting point 38 leftward beyond the thread receiving openings 7 of the thread guide plates 5, the detector 71 outputs a detection signal, for stopping the motor 58 and turning on the indicator 77.

Recognizing that the indicator 77 is turned on, the operator sets a new needle thread 1. In other words, the operator engages the spool (not shown) of this needle thread 1 with a spool pin (not shown) of the sewing machine and thereafter delivers the needle thread 1 from the spool (not shown). Then, the operator passes the needle thread 1 through a prescribed position, the clearance between the thread holding elements 20 and 21 of the thread tension guide 18, the lower side of the thread guide 24, the upper side of the thread take-up spring 22 and the thread receiving openings 7 of the upper and lower thread guide plates 5 for guiding the same to the eye of the needle.

Thereafter the operator further prepares for sewing and moves the sewing machine operating switch 69 to ON, so that the sewing machine starts sewing. When the sewing machine operating switch 69 is moved to ON, the indicator 77 is turned off as described above and the control system including the indicator 71 is inactivated. When the sewing machine operating switch 69 is moved to OFF, the motor 58 is stopped as described.

According to this embodiment, the sewing machine is provided with the detector 71 detecting that the thread engaging part 30 of the balance 28 is located in the vicinity of the forward movement starting point 38 leftward beyond the thread receiving openings 7 of the thread guide plates 5 and the indicator 77 operating on the basis of the detection signal from the detector 71 as described above, whereby the operator can recognize that the thread engaging part 30 of the balance 28 is located in the vicinity of the forward movement starting point 38 leftward beyond the thread receiving openings 7 of the thread guide plates 5 through the indicator 77. When the operator moves the balance 28 to a position for turning on the indicator 77, guides the needle thread 1 and thereafter operates the sewing machine, therefore, the thread engaging part 30 of the balance 28 can reliably capture and pull the needle thread 1 also immediately after the sewing machine starts to operate. Consequently, formation of no first stitch (the so-called skipping stitch), which is readily caused immediately after the sewing machine starts to operate, can be prevented.

According to this embodiment, further, the balance 28 can be automatically moved with the thread guide mode switch 75, whereby operability in thread guiding can be improved. In addition, the motor 58 is stopped on the basis of the detection signal from the detector 71 after the thread guide mode switch 75 is moved to ON, whereby the thread engaging part 30 of the balance 28 can be automatically moved to the position in the vicinity of the forward movement starting point 38 leftward beyond the thread receiving openings 7 of the thread guide plates 5.

According to this embodiment, as hereinabove described, the indicator 77 is formed by the LED, which is turned off when receiving the detection signal from the detector 71 while the motor 58 is stopped and turned off when the sewing machine operating switch 69 is moved to ON. Thus, the operator can readily recognize that the thread engaging part 30 of the balance 28 is located in the vicinity of the forward movement starting point 38 leftward beyond the thread receiving openings 7 of the thread guide plates 5.

Although the present invention has been described and illustrated in detail, it is clearly understood that the same is by way of illustration and example only and is not to be taken by way of limitation, the spirit and scope of the present invention being limited only by the terms of the appended claims.

For example, while the thread engaging part 30 of the balance 28 is located in the vicinity of the forward movement starting point 38 leftward beyond the thread receiving openings 7 of the thread guide plates 5 with the thread guide mode switch 75 after the sewing machine operating switch 69 is moved to OFF in the aforementioned embodiment, the present invention is not restricted to this but the thread guide mode switch 75 may be omitted for manually locating the thread engaging part 30 of the balance 28 in the vicinity of the forward movement starting point 38 leftward beyond the thread receiving openings 7 of the thread guide plates 5.

In other words, the upper shaft 57 is manually rotated when guiding the needle thread 1 (or exchanging the needle thread 1) before starting sewing with the sewing machine after stopping the motor 58 by moving the sewing machine operating switch 699 to OFF. When the thread engaging part 30 of the balance 28 is located in vicinity of the forward movement starting point 38 leftward beyond the thread receiving openings 7 of the thread guide plates 5, the detector 71 outputs the detection signal for turning on the indicator 77 on the basis thereof. The operator recognizing this activation of the indicator 77 may stop rotation of the upper shaft 57 and guide the needle thread 1. When the sewing machine operating switch 69 is thereafter moved to ON, the indicator 77 is turned off and the control system including the detector 71 is inactivated also in this case.

While the sewing machine operating switch 69 is built in the sewing machine in the aforementioned embodiment, the present invention is not restricted to this but the sewing machine operating switch 69 may be independent of the sewing machine. For example, the sewing machine operating switch 69 may be formed by a foot controller or the like.

What is claimed is:

1. A sewing machine comprising:

a thread guide plate having a thread receiving opening;

a balance having a thread engaging part and reciprocating through said thread guide plate so that said thread engaging part captures and pulls a needle thread when forwardly moving from left to right;

a first detector detecting that said thread engaging part of said balance is located in the vicinity of a forward movement starting point leftward beyond said thread receiving opening of said thread guide plate; and an indicator operating on the basis of a detection signal received from said first detector.

2. The sewing machine according to claim 1, further comprising:

an upper shaft so rotating that said balance reciprocates in association with rotation thereof, a motor driving said upper shaft, and a thread guide mode switch driving said motor.

3. The sewing machine according to claim 2, wherein said motor is stopped on the basis of said detection signal from said first detector after said thread guide mode switch is moved to ON.

4. The sewing machine according to claim 2, wherein said first detector includes:

a first detected element provided on said upper shaft, and a first photoelectric switch detecting said first detected element.

5. The sewing machine according to claim 4, wherein said first photoelectric switch of said first detector detects said first detected element when said thread engaging part of said balance is located in the vicinity of said forward movement starting point leftward beyond said thread receiving opening of said thread guide plate.

6. The sewing machine according to claim 1, further comprising a sewing machine operating switch operating said sewing machine, wherein said indicator is responsively inactivated when said sewing machine operating switch is moved to ON.

7. The sewing machine according to claim 6, wherein said motor is stopped to stop a needle on a top dead center when said sewing machine operating switch is moved to OFF.

8. The sewing machine according to claim 1, further comprising a sewing machine operating switch operating said sewing machine, wherein said indicator includes an LED, and said LED is turned on when receiving said detection signal from said first detector while said motor is stopped, and turned off when said sewing machine operating switch is moved to ON.

9. The sewing machine according to claim 2, further comprising a second detector for detecting at least the rotational position of said upper shaft, wherein said motor is stopped on the basis of a detection signal received from said second detector.

10. The sewing machine according to claim 9, wherein said second detector includes:

a second detected element provided on said upper shaft, and a second photoelectric switch detecting said second detected element.

* * * * *